US009695611B2

(12) United States Patent
Jimenez

(10) Patent No.: US 9,695,611 B2
(45) Date of Patent: Jul. 4, 2017

(54) FLEXIBLE MODULAR HABITAT

(71) Applicant: Juan Manuel Ceballos Jimenez, Mexico City (MX)

(72) Inventor: Juan Manuel Ceballos Jimenez, Mexico City (MX)

( * ) Notice: Subject to any disclaimer, the term of this patent is extended or adjusted under 35 U.S.C. 154(b) by 0 days.

(21) Appl. No.: 14/748,359

(22) Filed: Jun. 24, 2015

(65) Prior Publication Data

US 2016/0340925 A1 Nov. 24, 2016

(30) Foreign Application Priority Data

May 19, 2015 (MX) ..... 1MX/a/2015/006277

(51) Int. Cl.

| | |
|---|---|
| ***E04H 15/20*** | (2006.01) |
| ***E04B 1/343*** | (2006.01) |
| ***E04H 15/04*** | (2006.01) |
| ***E04H 15/22*** | (2006.01) |

(52) U.S. Cl.

CPC ..... *E04H 15/20* (2013.01); *E04B 1/34321* (2013.01); *E04H 15/04* (2013.01); *E04H 15/22* (2013.01); *E04H 2015/206* (2013.01)

(58) Field of Classification Search

CPC ... E04H 15/20; E04H 2015/206; E04H 15/22; E04H 9/14; E04H 1/1205; E04H 1/1277; E04H 2001/1294; E04H 9/00; E04H 9/16; E04H 15/04; E04B 1/34321

USPC ..... 52/2.15, 2.16, 2.17, 2.24, 81.1

See application file for complete search history.

(56) References Cited

U.S. PATENT DOCUMENTS

| | | | | |
|---|---|---|---|---|
| 377,435 | A * | 2/1888 | Perina | F16N 7/02 184/65 |
| 3,696,472 | A * | 10/1972 | Perina | A44B 18/0003 24/406 |
| 4,022,644 | A * | 5/1977 | Smith, Jr. | 156/79 |
| 4,041,671 | A * | 8/1977 | Nicholson | 52/745.07 |
| 4,121,389 | A * | 10/1978 | Ptaszek | 52/2.17 |
| 6,438,900 | B1 * | 8/2002 | Page | 52/2.23 |
| 7,089,703 | B2 * | 8/2006 | Brereton | 52/2.23 |
| 8,549,797 | B1 * | 10/2013 | Ricketts | 52/81.2 |
| 8,572,911 | B1 * | 11/2013 | Binienda | 52/202 |
| 8,763,326 | B2 * | 7/2014 | Takeshima | 52/236.1 |
| 2002/0083653 | A1 * | 7/2002 | Hilbert | 52/2.17 |
| 2006/0168898 | A1 * | 8/2006 | Chin | 52/2.17 |
| 2007/0000182 | A1 * | 1/2007 | Boujon | 52/2.17 |
| 2010/0077674 | A1 * | 4/2010 | Johnson et al. | 52/81.1 |
| 2010/0095605 | A1 * | 4/2010 | Belicofski | 52/81.1 |

* cited by examiner

*Primary Examiner* — Phi A

(74) *Attorney, Agent, or Firm* — Welsh Flaxman & Gitler LLC

(57) ABSTRACT

The present invention relates to a new inflatable and flexible modular habitat for welding in wells and/or high fire risk rated facilities, offshore and onshore to trap slag, sparks and the like, by a structure and/or module-based assembly. The structure can be resized and assembled on site to allow it to adapt to different applications of hot work without having to stop the production.

4 Claims, 7 Drawing Sheets

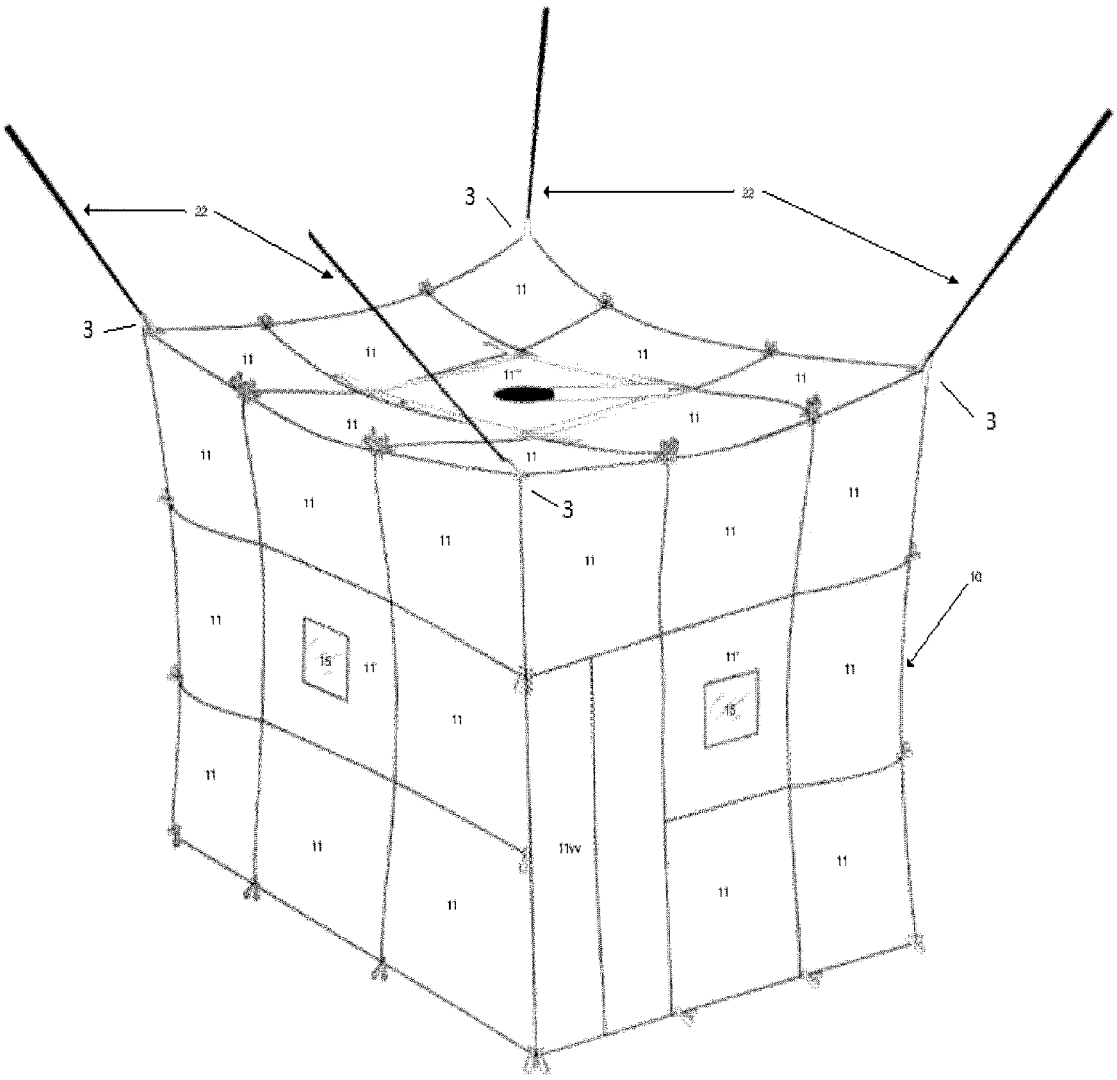
3
22
22
3
3
3
11
11
11

FLEXIBLE MODULAR HABITAT

FIELD OF THE INVENTION

The invention relates to a flexible modular habitat where the number of modules, assembled into the habitat, depends on the space available and facility to be covered. The flexible modular habitat is installed on-site, to safeguard welding in wells and/or high fire risk rated facilities. The habitat is used or catching slag, sparks, and the like. More particularly, the present invention is related to a module-based habitat for an assembly, which expands the safety of workers and provides greater security to infrastructures where this habitat will be used. The habitat provides outstanding and innovative features relative to the state of the art preceding the present invention; and further it utilizes individual modules that are sealed together to form the flexible modular habitat. The habitat can be modified or sized to reflect the different works within the habitat.

BACKGROUND OF THE INVENTION

Subsequent to the drilling of an underground oil or gas well, if such a well is located within or on a platform, a drilling ship or the like, the well is completed by the introduction of a tubular pipe, which is referred often to as the "casing". The casing is welded in place as part of the finishing operation.

Before or after the introduction of one or more sections of pipes that form the casing in the underground well, or the like, it may be required to perform several welding operations in one or more ends of the casing for the connection, for example, a leak preventer, heads, valves or other desirable components. It may be desired to fasten sections of each pipe of the casing. In many cases, such a component is fixed to the pipe members of the casing through welding operations by means well known in the industry.

As a result of the discharge of the flame from a welding plant, during the welding operation, sparks, slag and other inconveniences can be expected to be expelled in the air around the welding operation resulting in a serious risk during the welding operation. Slag and sparks could cause a fire or even worse, an explosion, as the casing is inserted often onto "live" wells, which sometimes could become uncontrollable at any time as a result of a breakdown or boiling of flammable liquids, such as natural gas or the like.

To address this danger, there is desired an enclosure that prevents or treats this problem by providing a habitat for welding in underground wells, which not only captures the slag and sparks during the welding procedure in an area which is isolated from the wellbore fluids, but the environment provides for controlled dissemination of slag and spark through habitat and away from the welding operation in a safe and controllable manner.

In the state of the art relative to that described above, there exists the following published documents: U.S. Pat. No. 2,872,933; U.S. Pat. No. 3,837,171; U.S. Pat. No. 3,946,571, U.S. Pat. No. 4,257,720; U.S. Pat. No. 5,018,321, Mexican Utility Model No. 1624 and Mexican Patent Application No. MX 308,953.

However, all these published documents have certain disadvantages and deficiencies that are accentuated when performing the welding process. As a result, it is desirable to make structural changes to these existing structures in order to provide greater benefits to workers and higher security to facilities where these activities are performed.

U.S. Pat. No. 2,872,933 relates to the construction of an air inflated ring cover which is used to cover drilling sites in oil wells, regardless of weather conditions. The cover is hanged by its top over the drilling site.

U.S. Pat. No. 3,837,171 relates to an underwater inflatable structure, which provides an artificial environment around a work area, for example, in a submarine base of an offshore oil platform, allowing for welding and the like to be performed. The structure comprises an integral sheet of material for a custom work or a number of selected sheets attached to the structural support elements. The material includes rack sections so that the material can be placed over and around the structural members in order to ensure a substantially airtight system. Neck sealing means are included on the structural members at their intersection with the sheet material and sealing means within the rack sections although the system could be used on land, it is particularly applicable to subsea situations.

U.S. Pat. No. 3,946,571 relates to an insulated module for use in environments with hostile temperatures that are uncomfortable for humans. This service module is lowered and put into service by the top of the module.

U.S. Pat. No. 4,257,720 relates to a capsule for works in the deep sea, allowing personnel access for maintenance work.

U.S. Pat. No. 5,018,321 discloses a flexible habitat for welding in underground wells to trap slag, sparks and the like. The habitat generally includes an air hanged external arched dome, which is mountable on an entry point of an underground well. The entry point of the underground well receives a pipe member which is extensible in the well and on which a process is carried out by welding. A fire resistant protective element is disposed about at least a bottom of the dome. Means are provided for selectively introducing air to hang the dome on the entry point. The means includes an air inductor motor, a fan, or the like. Means extend through the upper portion of the dome and away from the entry point to communicate with the inside of the dome to allow discharge of smoke including particulate matter, a result of welding procedure that is discharged from inside the dome. The means for introducing air and the means extending through an upper portion of the dome are aligned whereby the air supply forms a carrier stream for transmitting the smoke and particulate matter at least to the means extending through an upper portion of the dome, and preferably to transmit to and through the outside of the dome without the aid of any other means. The habitat also includes a fire resistant skirt which is available around the highest outermost portion of the pipe member. The guard is extended to ensure that the slag and the spark are not discharged downward around the outside of the casing or pipe member of transmission of fluid through the well. However, it has seen that in overworked hours, smoke and particulate waste is relatively excessive, tending to occlude the expulsion means of the habitat. This causes the worker to suffer significant health risks, and in the other hand, considerable costs are generated by the excessive change of filters which are arranged in the discharge means of the habitat.

Mexican Utility Model No. 1624 discloses a flexible habitat for welding in underground wells to trap slag, sparks and the like. The habitat generally includes an air hanged external arched dome which is mountable on an entry point of the underground well, which includes a ventilation system which is comprised basically of a structure porous sublayer arranged throughout the area comprising the dome of the habitat. The sublayer is releasably secured by conventional means, which serves as a filter.

However, upon conditions of use; particularly for U.S. Pat. No. 5,018,321 and Mexican Utility Model No. 1624, are not very favorable, as the degree of difficulty of assembling the structure in a work area is considerably high and dangerous, so the habitat of these two references are not suitable under the habitat occurs in one piece and resulting inconvenient to carry various habitat elements of different sizes. This causes the work schedules to be extended while the cost per hour/man rises considerably.

Mexican Patent No. 308953 and the state of the art cited, display wide shortcomings in their modularity to form the modular habitat and therefore reflect these deficiencies in the safety management to users and infrastructure where the modular habitat is used for working. These shortcomings are reflected in the management of tasks performed as the welding of tube. That is, in this reference, certain disadvantages are identified when performing the assembly process and adaptation in the workplace of the device for welding work, so the present invention overcomes these shortcomings by introducing structural changes in this habitat's modularity in order to provide greater benefits to the worker and the best development of the activities for which Flexible modular habitat was designed, while increasing the safety of workers and therefore infrastructure where the flexible modular habitat is installed.

In Mexican Patent No. 308,953, there is disclosed a flexible and inflatable habitat for welding in underground wells to trap slag, sparks and the like, by a module based structure and/or assembly. The structure allows different applications to fit different hot work applications without having to stop production. However, it has shortcomings by not hermetically sealing the contact of modular habitat with the element to be developed in works, so that security to the users and facilities is poor, and wherein it does not have security elements such as the emergency door.

A further advantage of the present invention over the art cited is the non-use of racks, stanchions or mechanical closures raised from "hard" devices or continuous use. Such lack of racks, stanchions or mechanical closures makes the current invention less susceptible to malfunction in assembly and disassembly of each the modules that form the flexible modular habitat. Thereby, the current invention increases the security provided within the modular habitat, by preventing the modules from separating or opening.

SUMMARY OF THE INVENTION

It is one of the objects of the present invention to provide structural improvements to existing habitats that enable a user to perform various jobs such as welding wells, pipes and/or other devices in high fire risk rated facilities, offshore and onshore. It is desirable to increase the versatility and modularity of flexible modular habitat, which allows, among other features, a user to adjust the size of flexible modular habitat to the conditions of required space, where the flexible modular habitat will be installed. This ability to select the number of modules allow for size adjustment for the resulting habitat. This feature is in addition to an individual module that allows for sealing with another module to form the flexible modular habitat. This sealing of the modules together is accomplished with the panel element provided. The flexible modular habitat allows for the catching of slag, sparks and the like, by the structure and/or module-based assembly (see FIGS. 1 and 2). This allows the habitat to adapt to different applications of hot work applications without having to stop the production, and reducing assembly times by simplifying the attachment devices of the modules that in turn provide escape routes from inside Modular Flexible Habitat to the crew. Also, there is provided at least one escape route provided in the facility. If desired, escape routes can be provided on opposite sides of the habitat.

It is an object of the present invention to enable the formation of the floor of the habitat with a plurality of individual modules. Each module forming the floor is preferably sized "0.50 cm×0.50 cm", thereby enabling the size of the floor to vary based upon the number of individual tiles assembled together. This makes the habitat adjustable to any type, size or amount of crossings of piping. The smaller size of the flooring modules also reduces the time of the floor assembly, avoiding stumbles and/or damage to tubular pipe crossings in the work area to be covered. The union of these individual modules is accomplished by a Velcro® type hook and loop type fastener closure mechanism. The individual modules are attached to one another at their edges using seams and in turn, the flaps are arranged in an opposing manner. This overlapping mechanism of the flaps is used in order have the Velcro® type hook and loop type fastener strips allow for assembly of the individual modules together. The overlapping structure obviates the needs for stanchions or racks, thereby achieving a faster assembly.

It is another object of the present invention to provide an adjustable composite module to accommodate cylindrical shaped pipes of different sizes ranging from a cylindrical shaped pipe having an OD (outside diameter) ranging from 10 cm to 76 cm, which fit through the opening or closing of the Velcro® type hook and loop type fastener closure and flap, thus eliminating the need to move the modular structure as a whole so that the center pipe is surrounded allowing for greater versatility for the suitability of the invention in any type of space in which the works are required to perform.

It is another object of the present invention to have an emergency exit module consisting of a module comprising about 2 meters high and about 1 meter wide that has in its middle, a removable device quickly arranged vertically, for allowing the user to make a quick exit.

Another object of the present invention is to provide a removable door, consisting of an aluminum structure attached to the structure through Velcro® type hook and loop type fastener closure, eliminating the use of racks or stanchions. This provides the ability of a user to easily release the entire structure of the door for a quick escape action from inside of the structure, if required by crew, for any incident that triggers an emergency protocol.

BRIEF DESCRIPTION OF THE DRAWINGS

A more complete appreciation of the improvements to the art that is embodied by the invention and many of the intended features and advantages thereof will be readily obtained as the same becomes better understood by reference to the following detailed description when considered in conjunction with the accompanying drawings, wherein:

FIG. 2 illustrates a perspective view of the rear of the flexible modular habitat for welding in wells and/or high fire risk rated facilities, offshore and onshore, according to the present invention, showing another view of modularity the walls and roof, plus emergency exit module.

FIG. 7*a* is an external view of the main module of adjustable composite module, FIG. 7*b* shows the setting insert, FIG. 7*c* shows the Velcro and the sealing flap, and FIG. 7*d* shows the interior view by placing the setting insert and the sealing flap of adjustable composite module.

DETAILED DESCRIPTION OF THE INVENTION

Figure 1:
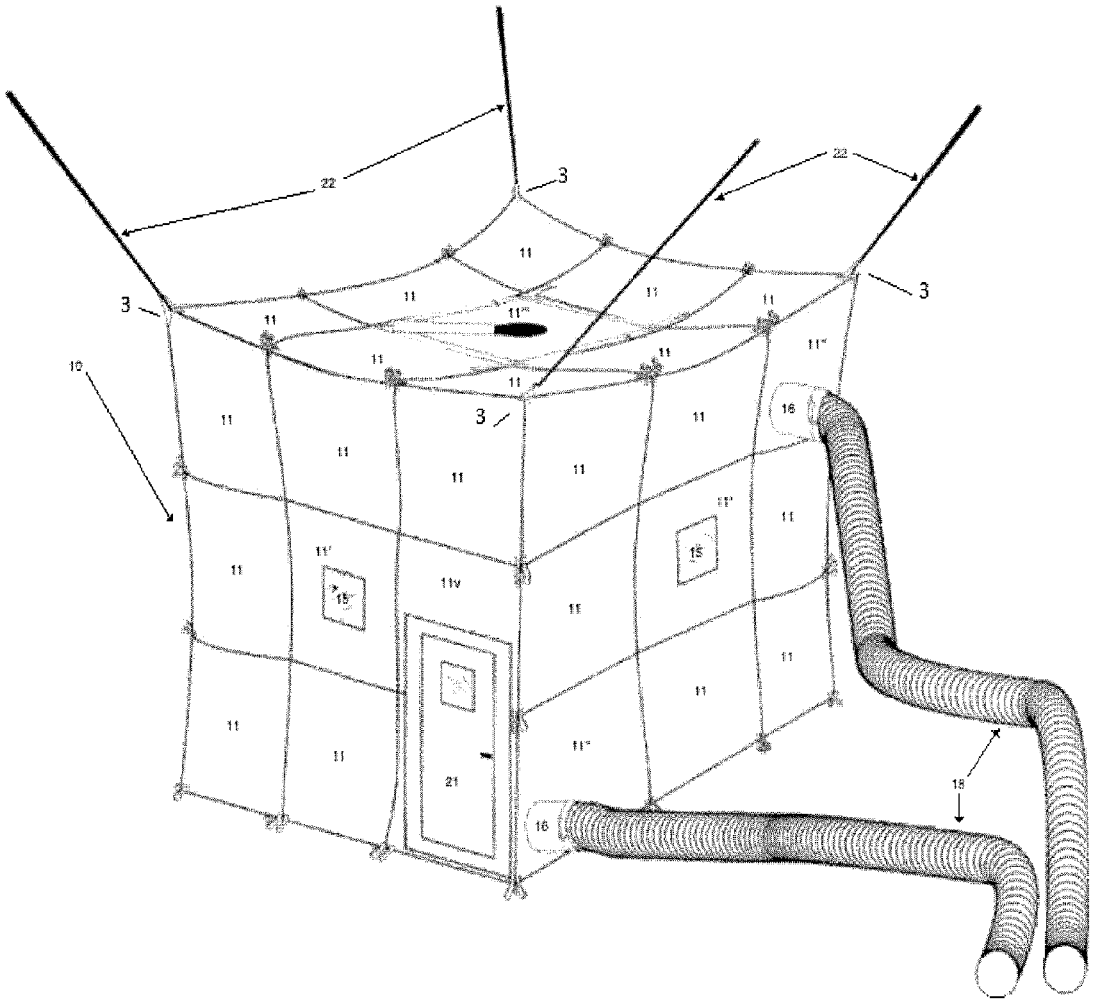
FIG. 1 illustrates a front perspective view of a flexible modular habitat for welding in wells and/or high fire risk rated facilities, offshore and onshore, according to the present invention, showing the modularity of the walls and roof, where for illustrative purposes but not limiting, the invention may have at least one flexible hose as air supply for inside the flexible modular habitat and at least one hose for air extraction.
Figure 4:
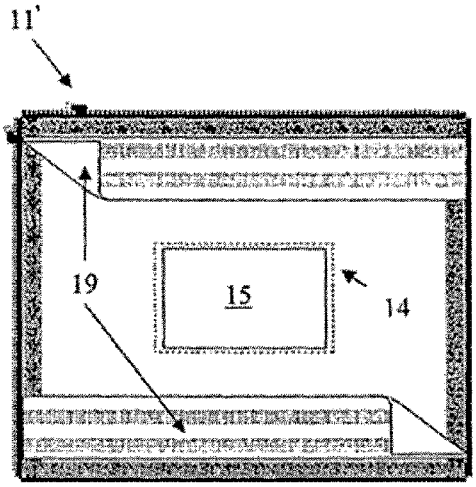
FIG. 4 illustrates a flat view of a module with a window for the habitat assembly according to the present invention.
Figure 5:
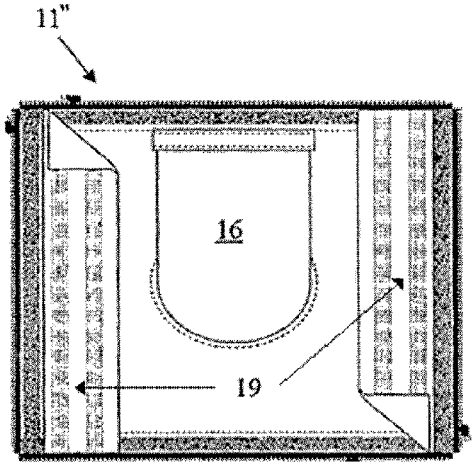
FIG. 5 illustrates a flat view of a module with a sleeve for the habitat assembly according to the present invention.
Figure 6:
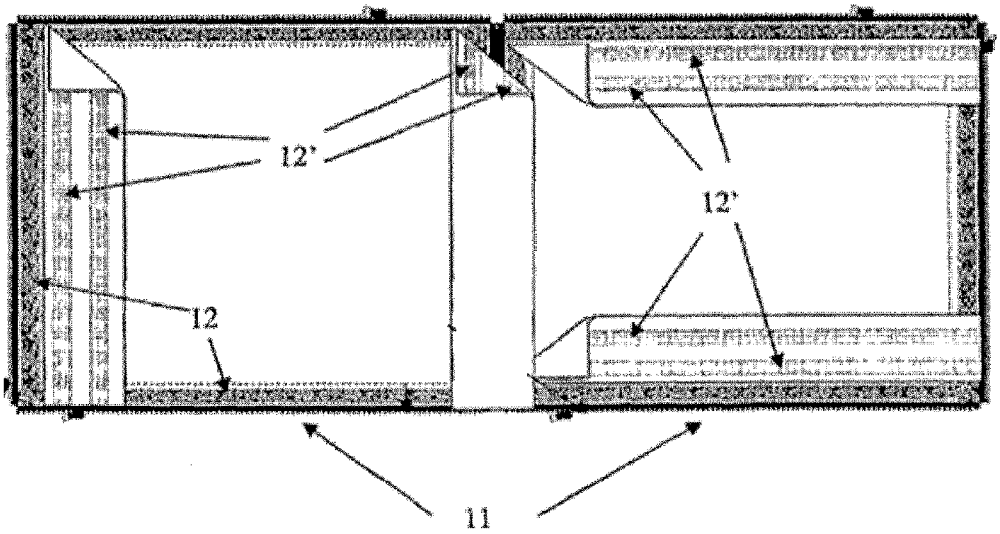
FIG. 6 illustrates a flat view of the connection between modules for habitat assembly according to the present invention.
Figure 7A:
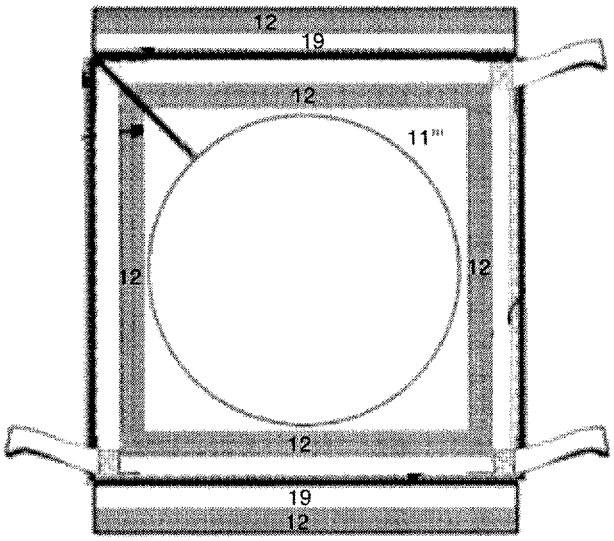
FIGS. 7*a*, 7*b*, 7*c* and 7*d* illustrate a flat view of the assembly of parts making up an adjustable module to smooth pipe for habitat assembly according to the present invention.
Figure 7B:
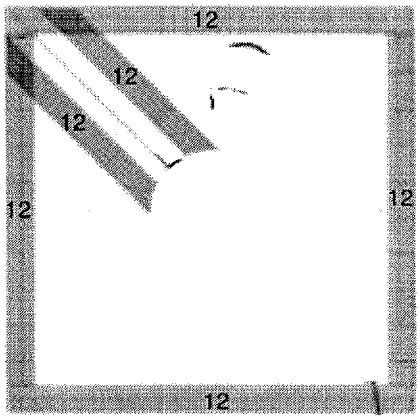
Figure 7C:
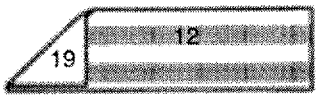
Figure 7D:
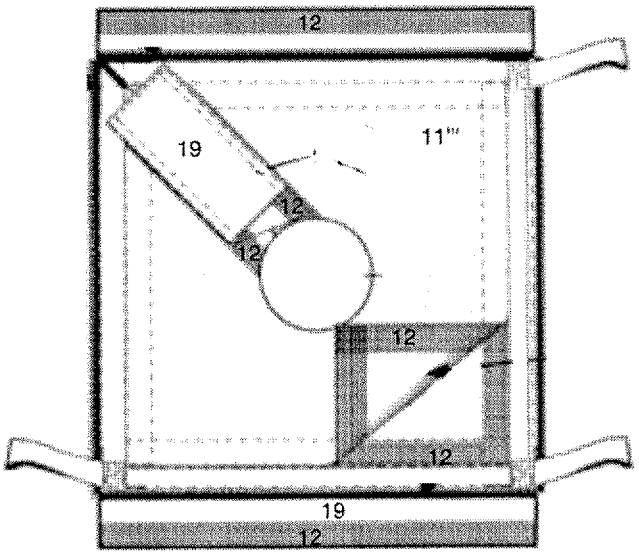

According to FIGS. 1 and 2, a flexible modular habitat 10 is shown which is already assembled, expanded and inflated. The flexible modular habitat 10 is composed of a plurality of individual modules 11, 11', 11", 11''', 11'''', 11*v*, and 11*vv* that are attached by a Velcro® type hook and loop type fastener closures 12. The flexible modular habitat 10 can also be supported via external supports (not shown) as an optional means using cables 22 to give greater stability when the working area is considerably large. The cables 22 are attached to the flexible modular habitat through attachment points or handles 3. Assembly of the flexible modular habitat 10 is performed in ascending order. In addition, the habitat 10 is preferably assembled using a second special module 11' with a window contained therein (see FIG. 4). The window comprises a gap 14 that has a transparent acrylic part 15 for monitoring and enabling control of the work performed from the outside or for other visual purposes and communication. Also, at least one third special individual module may be provided 11" that is provided with a sleeve 16 (See FIG. 5), which is attached to a flexible hose 18. This flexible hose 18 is attached to a fan (not shown) which is driven by a pneumatic motor through the flexible hose 18 for supplying air into the modular habitat 10.

Figure 3A:
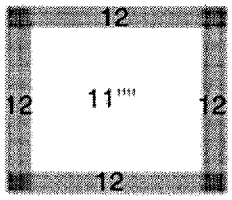
FIG. 3*a* illustrates a flat view of one of the plurality of modules forming the floor.
Figure 3B:
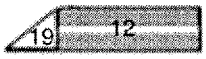
FIG. 3*b* illustrates the face of Velcro and flap.
Figure 3C:
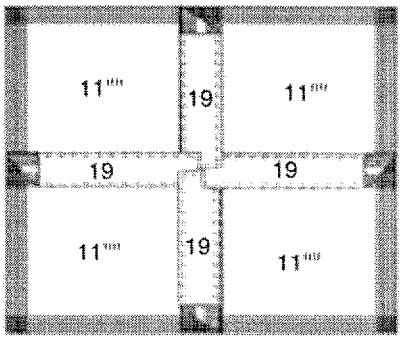
FIG. 3*c* illustrates the connection between the modules and the way the floor is made up.
Figure 3D:
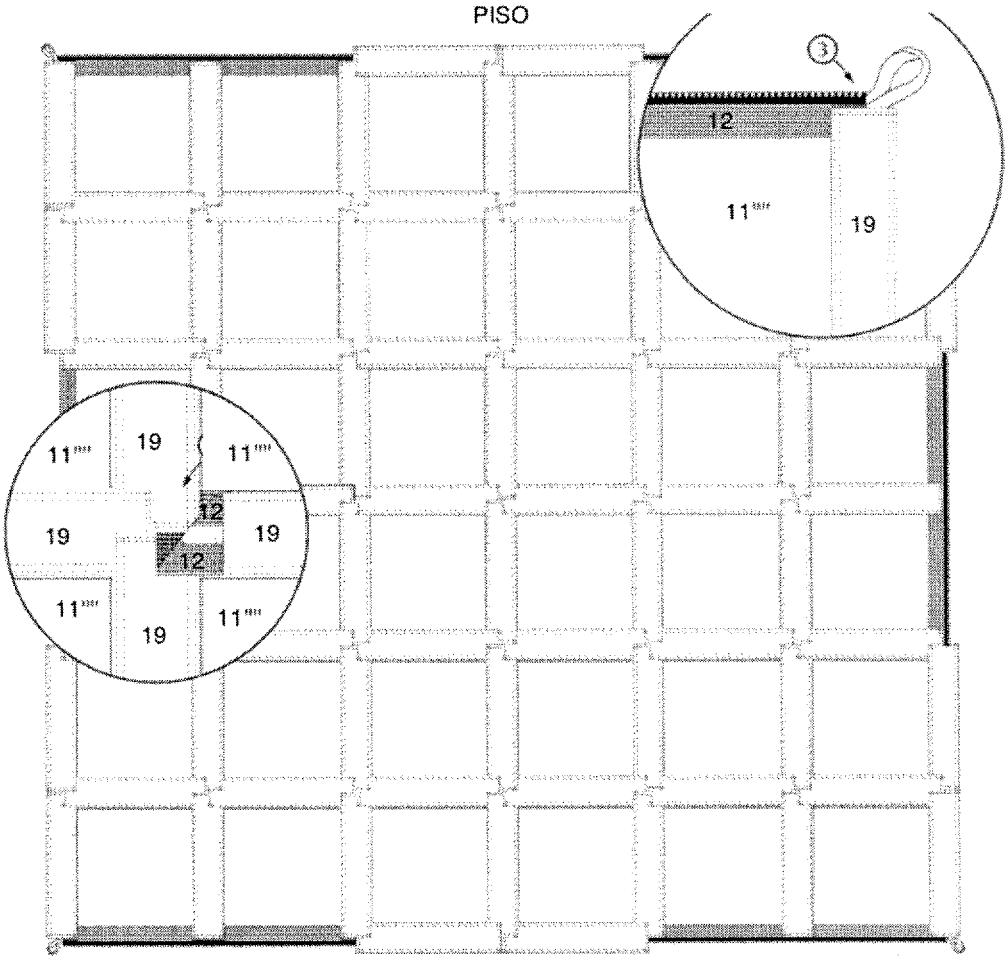
FIG. 3*d* illustrates the top view of the formation of the floor.

At the periphery or edge of each individual module, there is provided one or more strips of Velcro® type hook and loop type fastener closures (FIG. 3*b*) which is attached to each individual module via stitching and in turn, has one or more flaps 19 (See FIGS. 3*a*, 3*b*, 3*c* and 3*d*) arranged oppositely, in order to cover the Velcro® type hook and loop type fastener closure strip 12 for each more enabling two or more modules to be assembled together. (See FIG. 3*c*). The flaps 19 are important because they serve as a mechanism of secondary sealing securing to prevent any leakage of slag or sparks out of modular habitat 10. The flaps 19 operate as a secondary emergency sealing reinforcement as a result of them having a pair of strips of the Velcro® hook and loop type fastener closures 12.

The plurality of individual modules 11, 11', 11", 11''', 11", 11*v*, and 11*vv* (See FIG. 1), assembled together, comprise the modular habitat 10 which can be made of a silicon fiber cloth material which may withstand temperatures upwards of 315° C.

The compound individual module 11''' for attachment to a pipe (See FIGS. 7*a*, 7*b*, 7*c* and FIG. 7*d*) is composed of four pieces that are assembled to achieve an accurate fit at the required location as the need arises in places in which the work will be done using the flexible modular habitat, as it allows for attachment together by a Velcro® type hook and loop type fastener closure 12. The module body is formed around the outer diameter of a pipe within the Outer diameter range of 10 cm to 76 cm, thereby allowing sealing of this joint.

The plurality of individual modules that form the floor 11" (See FIG. 3*d*) allow for greater versatility for its modularity to suit the characteristics and conditions that present the places where the work will be performed, namely where the flexible modular habitat is used, because the floor modules have a smaller size that is preferably 0.5 m×0.5 m in square. Assembly of a number of individual modules is required to cover the entire work area. On the floor inside the modular habitat 10, a fire resistant protector (not shown) is provided, which can be made from flexible refractory material. The fire resistant protector should be placed inside of habitat 10 to completely weld around the interior at a height of about 91 cm above the highest end of the casing to help control the slag and sparks in the welding operation. The welder will perform a welding operation using a conventional arc process that fixes the element to be secured to the casing.

Figure 8A:
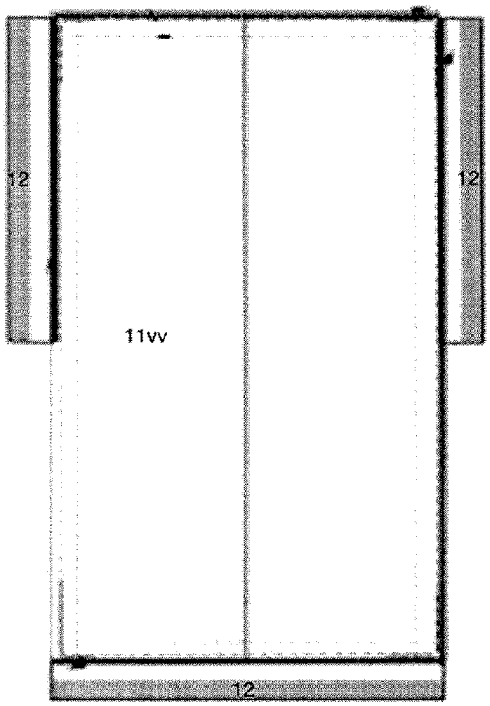
FIGS. 8*a* and 8*b* illustrate an external and internal flat view respectively of Emergency Exit module for habitat assembly according to the present invention.
Figure 8B:
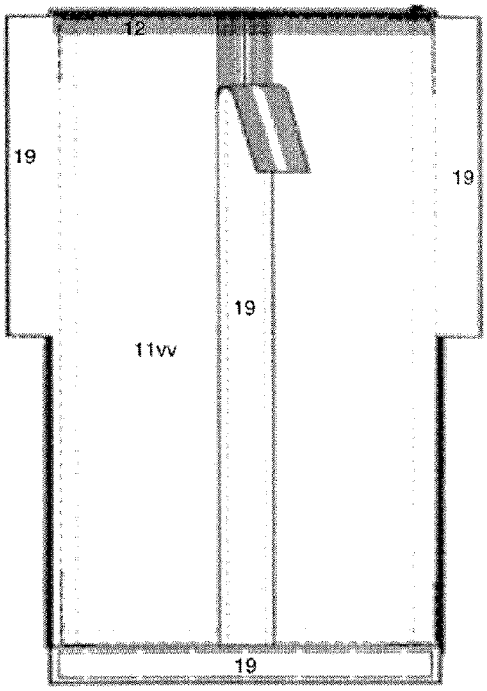

A door module 11*vv* or emergency exit (See FIGS. 8*a* and 8*b*) is assembled in the flexible modular habitat by a Velcro® type hook and loop type fastener closures 12, sealing the joints of the door with flaps 19. Such a door module is included to provide a quick exit or entrance into the flexible modular habitat if required by any unexpected incident unwanted because it has a joint closed by a Velcro® type hook and loop type fastener type closures 12 arranged and easy sealing flap 19 to help control the slag and sparks in the welding operation. The welder will perform a welding operation using a conventional arc process that fixes the element to be secured to the casing.

The flexible modular habitat has a joint with Velcro® type hook and loop type fastener closures 12 and a sealing flap 19 for easy separation, that is vertically provided and spanning 2 meters high off the ground for the emergency door module.

Figure 9A:
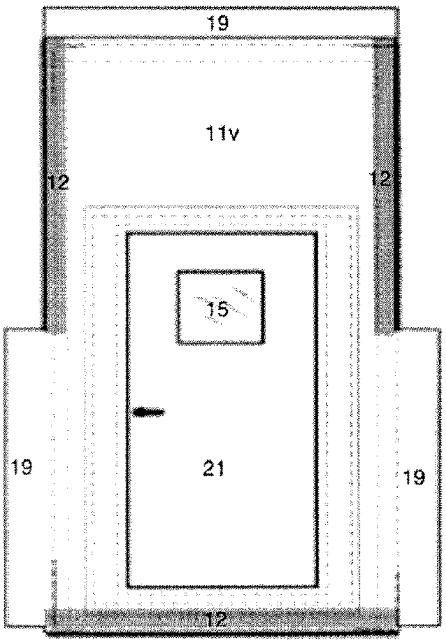
FIGS. 9*a*, 9*b* and 9*c* illustrate an exterior flat view of the door module, an interior view of the removable door module and the door for habitat assembly respectively according to the present invention.
Figure 9B:
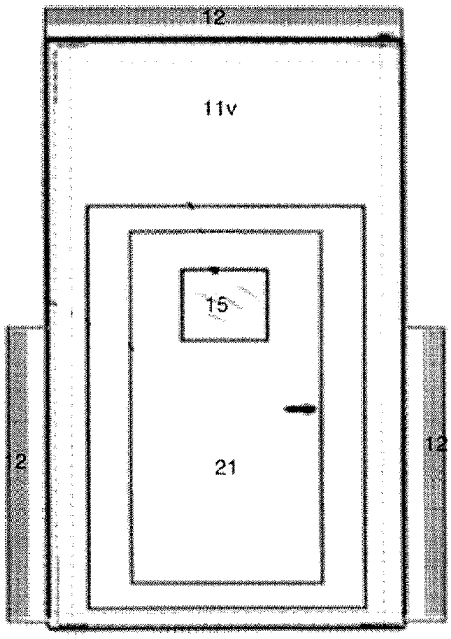
Figure 9C:
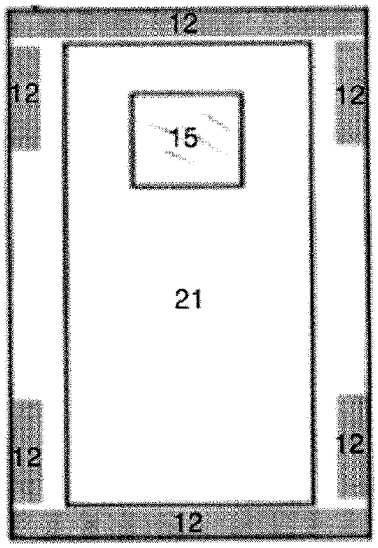

A variation of the module 11*v* for a removable door 21 (See FIGS. 9*a*, 9*b* and 9*c*) with inlet and outlet pressure gauges (not shown) is provided, so that the crew can enter into the modular habitat 10. The door 21 is affixed to the module 11*v* with Velcro® type hook and loop type fastener closures 12, allowing quick and easy removal if required due to a sudden situation occurring inside the habitat, as the result of an emergency. In this embodiment, the removable door may or may not include a space for insertion of an acrylic window 15.

The modular habitat 10 may be conveniently stored in the separate condition. That is the modules are kept in an unassembled form. When it is desired to be used, each piece or module is carried to the area immediately adjacent to the well. Each module 11, 11', 11", 11'", 11"", 11*v*, and 11*vv* is then attached, and placed over the pipe or piping.

Subsequently, a blower fan (not shown) is affixed to the sleeve 16 of special module 11" through a flexible hose 18 for introducing the air supply into flexible modular habitat 10. A second special module 11" with a sleeve 16 is attached to the other side of the modular habitat 10 with an exhaust fan (not shown) driven by a pneumatic motor (not shown) in order to release the air circulating inside the same habitat.

While the blower fan forces the air into the modular habitat 10, it expands to the desired suspension over the well and with the help of cables 22, which are pulled in an ascending fashion. At this time, the habitat proceeds to externally seal over the casing or piping by use of the assembled flexible modular habitat 10.

The invention claimed is:

1. A flexible modular habitat used to perform welding tasks in high fire risk rated facilities comprising:

a structure formed by a plurality of individual modules assembled together forming a floor of the flexible modular habitat, a plurality of individual modules assembled together forming a roof of the flexible modular habitat, and a plurality of individual modules assembled together forming walls of the flexible modular habitat to produce an assembled flexible modular habitat, each of the modules being formed from a material withstanding temperatures of 315° C.;

an external supporting cable attached to the structure and oriented in an ascending manner to support the structure;

a device for introducing air inside of the assembled flexible modular habitat that expands the assembled flexible modular habitat for suspension over the high fire risk rated facilities, the device for introducing air including a sleeve secured to one of the plurality of individual modules assembled together forming walls of the flexible modular habitat and a hose attached to the sleeve;

a device for releasing air circulating in flexible modular habitat, the device for releasing air including a sleeve secured to one of the plurality of individual modules and a hose attached to the sleeve;

a periphery of each of the plurality of individual modules assembled together forming the floor of the flexible modular habitat, each of the plurality of individual modules assembled together forming the roof of the flexible modular habitat, and each of the plurality of individual modules assembled together forming walls of the flexible modular habitat, has one or more strips of hook and loop type fastener stitched thereon and at least one flap having a pair of hook and loop type fasteners shaped and dimensioned for engagement with the strips of hook and loop type fastener on adjacent individual modules;

wherein at a seam between the adjacent individual modules the at least one flap covers and seals the strips of the hook and loop type fastener on the adjacent individual modules to assemble together the adjacent individual modules and to enable secondary sealing thereby preventing leakage of slag or sparks out of the assembled flexible modular habitat.

2. The flexible modular habitat according to claim 1, wherein each of the plurality of individual modules forming the floor is measured 0.50×0.50 cm.

3. The flexible modular habitat according to claim 1, further comprising a removable door constructed of aluminum and attached to the flexible modular habitat via hook and loop type fastener closures covered by the flaps.

4. The flexible modular habitat according to claim 1, further comprising a window in at least one of the plurality of individual modules forming walls of the flexible modular habitat.

* * * * *